166-66 SR

11/4/86 XR 4,620,593

United States Patent [19]

Haagensen

[11] Patent Number: 4,620,593

[45] Date of Patent: Nov. 4, 1986

[54] OIL RECOVERY SYSTEM AND METHOD

[76] Inventor: Duane B. Haagensen, 5424 W. Highwood Dr., Edina, Minn. 55436

[21] Appl. No.: 656,753

[22] Filed: Oct. 1, 1984

[51] Int. Cl.[4] ..... E21B 43/24; E21B 47/12

[52] U.S. Cl. ..... 166/248; 166/53; 166/60; 166/66; 166/250; 219/10.55 A; 219/10.55 F

[58] Field of Search ..... 166/60, 61, 65 R, 66, 166/53, 248, 250; 219/10.55 A, 10.55 F, 10.65, 10.81, 277, 278

[56] References Cited

U.S. PATENT DOCUMENTS

| | | | |
|---|---|---|---|
| Re. 30,738 | 9/1981 | Bridges et al. | 166/248 |
| 403,183 | 5/1889 | Firth | 166/61 |
| 2,685,930 | 8/1954 | Albaugh | 166/60 X |
| 2,757,738 | 8/1956 | Ritchey | 219/278 X |
| 3,133,592 | 5/1964 | Tomberlin | 166/60 |
| 3,170,519 | 2/1965 | Haagensen | 166/60 |
| 3,187,814 | 6/1965 | McCarthy | 166/61 X |
| 3,632,945 | 1/1972 | Johnson | 219/10.55 A |
| 4,135,579 | 1/1979 | Rowland et al. | 166/248 |
| 4,140,179 | 2/1979 | Kasevich et al. | 166/248 |
| 4,140,180 | 2/1979 | Bridges et al. | 166/248 |
| 4,144,935 | 3/1979 | Bridges et al. | 166/248 |
| 4,193,448 | 3/1980 | Jeambey | 166/60 |
| 4,275,283 | 6/1981 | Focht | 219/10.55 A X |
| 4,301,865 | 11/1981 | Kasevich et al. | 166/248 |
| 4,436,148 | 3/1984 | Maxwell | 166/53 |
| 4,449,585 | 5/1984 | Bridges et al. | 166/248 |
| 4,457,365 | 7/1984 | Kasevich et al. | 166/248 X |
| 4,524,826 | 6/1985 | Savage | 166/248 |

*Primary Examiner*—George A. Suchfield
*Attorney, Agent, or Firm*—Peterson, Wicks, Nemer & Kamrath

[57] ABSTRACT

A slotted radiating unit is lowered into a well casing of limited cross section, and microwave energy is fed downwardly thereto via a transmission line also installed in the casing. Two embodiments of the radiating unit are disclosed, and two embodiments of the transmission line are also described. Depending upon the subterranean conditions, periods of on and off microwave propagation are sometimes employed; in some instances dual radio frequencies are utilized to enhance petroleum flow. Subsurface sensors are made use of to control the ground level radio frequency generator (or generators).

53 Claims, 11 Drawing Figures

28
OIL STORAGE
SUCKER ROD
24
27
26
FLOW METER
42
NITROGEN SUPPLY
46
CONTROL DEVICE
48
38
R.F. GENERATOR
30
56
COMPUTER
58
INTERFACE
60
62
12
66
2
22
32
72
10
82
18
36
78
80
84
86
20
88
16
68
90
114
14
96
3
92
98
4
34
94
70

R.F. GENERATOR
38

28
132
140
130
OIL STORAGE
18
22
7
7
132
10
140d
140e
156
150
100
96
154
152
152
88
92
114
16
96
32
98
114
90
94

OIL RECOVERY SYSTEM AND METHOD

BACKGROUND OF THE INVENTION

1. Field of the Invention

This invention relates generally to the subterranean heating of oil-bearing earth formations, and pertains more particularly to a system and method for heating such formations with microwave energy.

2. Description of the Prior Art

The need for tapping more difficult underground reservoirs containing petroleum impregnated media, such as oil shales, tar sands and the like, has been recognized for a number of years. Although numerous procedures have been tried, many obstacles have interfered with the effective and efficient production of oil from the sands and shale, as well as other formations, that contain the heavy crude oil.

Perhaps the most notable of the prior art techniques has been the use of steam that is injected into the surrounding earth strata. To do this, costly steam generators are required and the steam generators consume appreciable quantities of fuel, which in turn increases the overall cost. Besides, extensive lengths of pipes through which the steam flows must be insulated, and even then considerable thermal losses are experienced. Of course, some oil fields lend themselves more readily to steam injection than do others. In this regard, some are too shallow. Others are too deep. Besides, the formation itself poses a problem in many instances because it must be sufficiently porous so that the steam can penetrate adequately; even then, a considerable amount of heat is lost and lowers the recovery rate of the fluid so that the claiming of the residual crude oil becomes increasingly more difficult to recover.

There is also the so-called fire flood method that has been employed for secondarily recovering crude oil products. This has been tried more on an experimental basis than commercially. This method is not only dangerous but also consumes a portion of the recoverable crude oil during the removal process. In this regard, close control must be exercised with respect to the in situ fires, these fires sometimes being deep beneath the earth's surface. Also, the well is subjected to "coking" or gumming of the formation due to the excessive temperatures that are used. As with the steam injection method, the fire flood method suffers the common shortcoming of leaving a considerable quantity of crude in the formation with the concomitant impediment to future recovery thereof that has been experienced to a large degree with the steam technique.

Electrically heating the heavy crude oil formations has also been attempted over a number of years and has attracted a number of adherents who have attested to the success of the method. However, when attempting to transfer heat exclusively by conduction, it naturally develops that some subterranean formations are poorer electrical conductors than other formations; by the same token, some formations are thermally inferior as well. Implementation of complex heating arrangements which have included multiple injection and recovery bore holes have met, along with other drawbacks, serious economic limitations. Consequently, none of the electrical heating systems have performed satisfactorily enough to warrant any wide-scale commercial utilization thereof.

As early as the 1950's, the concept of stimulating oil flow by reducing the viscosity of heavy crude oils with high frequency electromagnetic energy was envisioned. However, during the era, the application of microwave energy was still in its infancy. Many early efforts involving the use of microwave energy proved to be impractical because of technological limitations. Even more recently with the advent of improved microwave equipment, there has remained the problem of dielectric properties being exhibited by virtue of diverse geographical formations and the interaction of the high frequency energy therewith.

One salient explanation for the lack of growth, as far as recovering oil with high frequency radiation, lies in the fact that the oil recovery devices and systems have not taken into adequate consideration the various parameters of the petroleum industry. Thus, a number of prior art microwave systems have failed to address, expecting instead that the oil industry would adjust to the electronic innovations, the actual needs of the industry itself. This lack of cooperation between the manufacturers of the microwave equipment and the petroleum industry has manifested itself in various ways. One such way has been concerned with the design of electronic heating systems that are too fragile to be handled by typical oil well crews, and are also too delicate to be incorporated in oil wells of the usual type and size. Furthermore, a number of the prior art systems have been unduly complex and not easily adapted to typical oil field practices, for they were not rugged enough. Still further, some required elaborate instrumentation making use of a plurality of bore holes, and an important criteria that was lacking from a number of such systems was the capability of the recovery equipment to fit into bore holes of current size so that the bore holes would not have to be restructured in order to accommodate the elaborate electronic paraphernalia. Being able to fit in an existing well bore is highly important where the well is partially depleted and which must be reopened with the expectation of an ample economic return to the investor; the economics of the situation simply does not permit a restructuring of the existing well bore.

It should be noted that a secondary oil recovery system in order to realize any commercial acceptance must operate with a minimum of technological complications. For instance, the location of power tubes and requisite electronic hardware in the well bore itself leaves too much control to chance. It should be readily apparent that if any failure occurs, the entire pump string has to be pulled which costs both time and money. Even though the advantages of electronic exploitations, particularly those employing high frequency generation, of heavy oil environs have received the accolades of respective specialists in both the petroleum and microwave industries, the fact remains that there is still a need for a practical system and method that will be both effective and efficient.

SUMMARY OF THE INVENTION

Accordingly, a general object of my invention is to provide an improved system and method for efficiently transmitting microwave energy into oil bearing layers subterraneanly located beneath the earth's surface. In this regard, it is within the contemplation of the invention to employ one form of transmission means for shallow oil wells and another form for deep wells. More specifically, a coaxial transmission line can be used for relatively shallow wells where attentuation is not a problem, and a special waveguide in deeper wells in order to minimize transmission losses. It is an aim of the invention to couple the lower end of the coaxial transmission line to the upper end of a modified or enhanced slotted antenna or radiator unit so that the microwave energy is efficiently propagated into the particular pay zone in the surrounding region at the depth that the slotted antenna has been positioned. With respect to employing a waveguide, it is an object of the invention to utilize a waveguide of sufficiently small cross section so that it can be inserted within standard well casings. A sufficient number of microwave propagation units are successively connected together in order to reach the desired depth. The waveguide is configured and dimensioned so as to fit the well bore. The overall length of the waveguide, even on the order of 1000 feet or so, does not significantly attenuate the microwave energy being transmitted downwardly.

Another object of the invention is to provide sufficient miniaturization of the slotted antenna so that it, too, fits within a conventional well casing.

Another object is to provide a waveguide that is configured so as to accommodate in a grooved wall thereof a longitudinal portion of the usual production oil tubing through which the recovered oil is pumped. Thus, valuable space is conserved within the well casing because of the reception of appreciably half of the production tubing in the groove formed in one wall of the waveguide. It is also an aim of the invention to utilize the production tubing carrying the recovered oil upwardly for cooling the waveguide. Still further, it is contemplated that the combined production tubing and waveguide be sufficiently rigid so that any swaying is minimized or even obviated, thereby avoiding the use of any centralizers.

For another object it is intended that the specially configured waveguide continue into the so-called pay zone, where appropriate resonant slots transform the lower portion of the waveguide so this portion functions as the radiator.

Yet another object of the invention is to provide underground monitors that sense the amount of electromagnetic energy that has been radiated from the slotted antenna, thereby providing an indication of the effectiveness of the radiated energy. More specifically, it is within the purview of the invention to utilize the various signals that are sensed by the monitors or detectors, the signals being telemetered upwardly to appropriate electronic equipment at ground level which includes a computer that then optimumly controls the radio frequency generator (or generators) that are feeding the microwave energy into the upper end of the coaxial transmission line or waveguide, as the case may be, so that the amount of energy transmitted downwardly to the slotted antenna is controlled, the radiation being increased or decreased in accordance with the magnitude or value of the telemetered signals picked up by the electromagnetic sensors.

Another object of the invention is to provide pulsed radio frequency energy so that effective fluid drives are initiated or developed during the propagation period, and which energy results in a sufficient fluid drive pressure in the subterranean oil-laden strata that is adequate to continue, and actually increase, the flow of petroleum in the direction of the slotted antenna and hence to the lower end of the production tubing which carries the fluid upwardly to a surface-located storage facility.

Also, the invention has for an object the utilization of conventional pumping equipment, my system being compatible with the usual walking beam or horsehead pumping apparatus.

Still another object of the invention is to utilize dual radiation wavelengths so as to produce gravity flows in horizontal oil beds, the dual radiation enhancing the overall volume of flow.

Another object is to provide an economically viable electronic system for the recovery of subsurface hydrocarbons that can be conveniently pulled out of the well casing and successively reassembled in other well bores, only a minimal amount of effort being needed. More specifically, it is intended that the isolation of critcal electronic components coupled with a reusable encapsulated recovery antenna make the system transportable without elaborate transfer mechanisms and procedures.

Another object, this being a specific object in addition to the others herein given, is to construct a sealed recovery system which is rugged enough that oil field crews can implement the system without danger of damaging fragile electronic components that heretofore have been employed in recovery procedures. The radio frequency antenna or radiator unit is of solid construction, being hermetically enclosed in an encapsulated form, while the power source and controls are located at ground level in suitable protective housings so as to eliminate any abuse of critical components. The separation of the active and the passive components gives the system a flexibility not heretofore feasibly obtained.

An important additional object of the invention is to introduce an effective means for heating and recovering fossil fuels without incurring the added expense and related difficulties of having to drill multiple bore holes in the oil-laden formation by being compelled to employ associated injection equipment. The instant invention utilizes the dielectric properties of hydrocarbon deposits wherein the majority of the elements conduct the RF signal appreciable distances from the well bore while minority elements act to attentuate the signal with a resultant heat transfer which culminates in a viscosity reduction and subsequent flow of the treated fossil fuels. Strictly conductive heating, such as that provided by conventional electrical heating elements, cannot accomplish the instantaneous saturation of oil bearing formations, as my system is capable of doing.

The invention has for a further object the facial unplugging of the stratum encircling the antenna, thereby increasing the porosity of the subterranean formation and concomitantly decreasing the pressure that must be generated in order to induce the flow of the petroleum-laden fluid.

An additional object of the invention is to provide for the efficient transfer of radio frequency energy that is generated above ground to an effective radiating antenna located proximally with a hydrocarbon formation, this being achieved by utilizing a low-loss transmission line in the form of a waveguide which can be conveniently strapped or otherwise fastened to the pump tubing and concurrently lowered into the well bore. The system lends itself readily to having an inert gas, such as nitrogen, introduced which not only enhances the propagation of the radio frequency signals but also militates against arc-overs and leaks that may occur because the pressure within the transmission line is greater than the circumjacent region by reason of the pressurization.

It is still to be noted that another object of the invention provides a safe secondary recovery method which has no deleterious effect as far as either above or below ground environments are concerned.

Another important object is to provide a microwave antenna unit that is capable of spiral radiation patterns in order that the entire periphery of the well bore in both a horizontal and vertical plane within predetermined parameters is equally influenced. Vertically oriented resonant slots in the antenna unit are included in an electrically "correct" disseminating array and specifically controlled with respect to phase and amplitude at desired frequencies to match the impedance presented within a given geographical formation. The significant reduction in reflected power at the formation interface allows increased penetration and transfer of the radio frequency signal into more remote regions of the substrate.

It is a further object of the invention to provide a radiating system that encompasses a successful interrelation between the propagation characteristics of longer wavelengths and the heating capabilities of shorter wavelengths. Therefore, it is within the purview of the invention to alternate frequencies, doing so either simultaneously or successively, in order to derive improved pressure drives resulting from the relaxed thermal or chemical pressure gates. It is also within the scope of the invention to influence these same or similar pressure gates by resort to periodic pulsating radio frequency signals.

Briefly, my oil recovery system includes one microwave generator, but preferably two in some cases, located above ground. The microwave or radio frequency signals are transmitted via a low-loss transmission circuit in the form of a coaxial transmission line or specially configured waveguide to an improved slotted antenna or radiating unit. The coaxial transmission line itself is conventional but the waveguide has a groove in one wall thereof for receiving approximately half the cross section of the production tubing through which the recovered fluid is pumped. The antenna or radiating unit has a series of vertically spaced slots therein, the slots when appropriately tuned defining radial radiation patterns best suited for particular oil-bearing strata. As a result, the power available for propagation or broadcast into the subterranean regions surrounding the well bore is substantially increased.

Miniaturization of the antenna or radiating unit, as far as one embodiment is concerned, is achieved by lengthening the peripheral path from one side of the resonant slot to the other. In this regard, a U-shaped, somewhat box-like accessory is attached to the radiator along one side of each slot so that the peripheral distance is substantially increased without exceeding the internal diameter of the well casing. The antenna or radiating unit, quite obviously, must pass through the well casing in order to reach the various underground strata that are to be subjected to the microwave propagation. By using two radio frequency generators, a dual radiation is produced that enhances the gravity flow in horizontal oil beds. Thus, a relatively high frequency and a relatively low frequency can be either simultaneously radiated into the surrounding oil bearing regions or one frequency can be employed at one time, successively and alternately followed by a second frequency. In either event, the drive pressures resulting from the thermal expansion increases the degree of oil recovery. It is also within the contemplation of the invention to pulse the radio frequency source or sources so as to provide fluid drives in the absence of radio frequency energy. In other words, the radio frequency generator that is producing the microwaves can be turned on and off at predetermined times so as to cause an increase in the flow of fluid when there is no microwave energy being propagated into the subterranean soil at that time. As far as a second embodiment is concerned, the waveguide is, in effect, lengthened, and angled slots of appropriate size are formed in one wall of the waveguide for the propagation of the microwave energy into the encompassing pay zone.

DESCRIPTION OF THE PREFERRED EMBODIMENT

Figure 1:
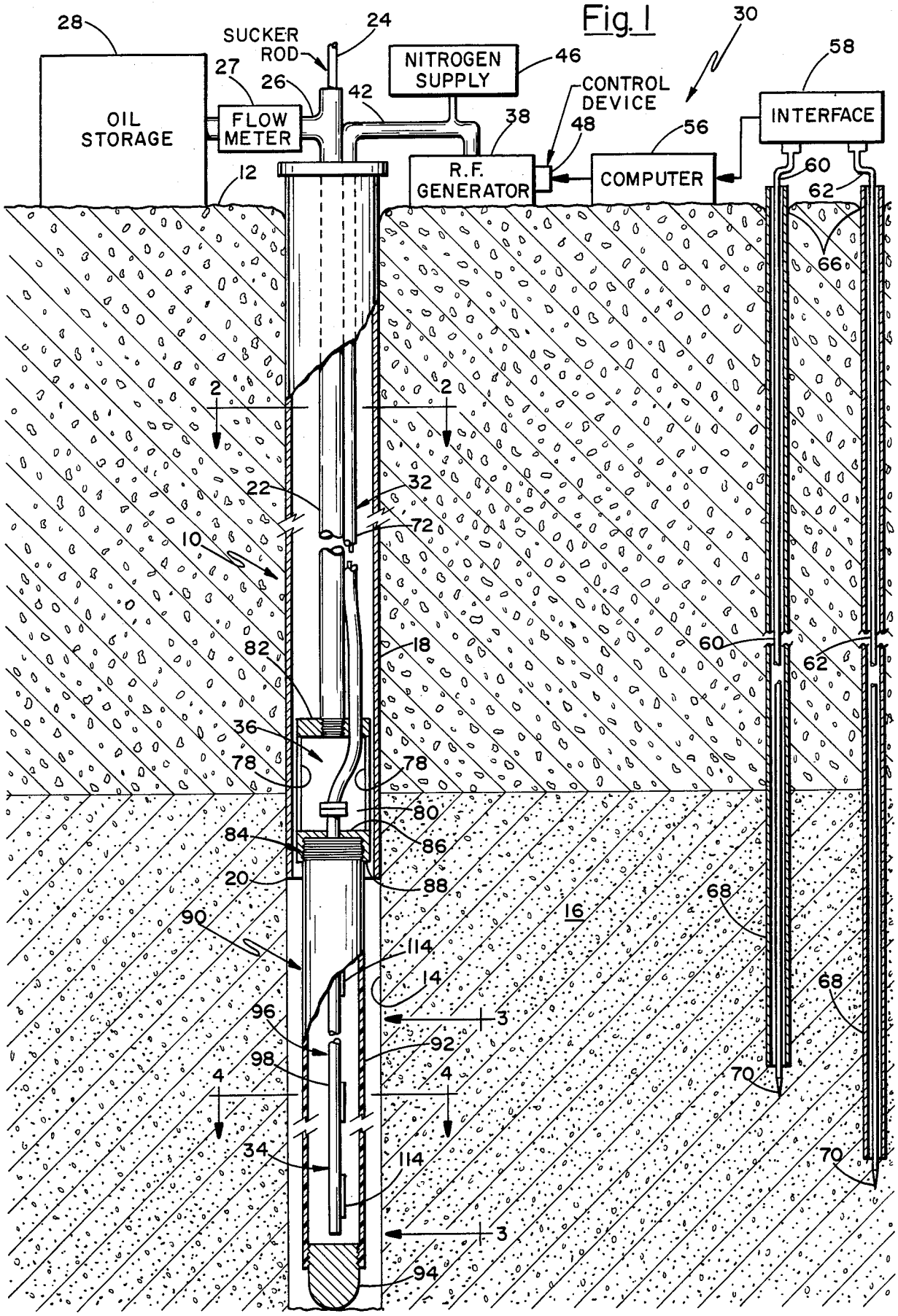
FIG. 1 is an elevational view of an oil well in which the system includes a coaxial transmission line, a slotted antenna or radiating unit, and means for monitoring the amount of radiated power received at two laterally spaced locations plus surface disposed means for controlling the amount of radiated power, a portion of the well casing having been removed, as well as a portion of the antenna shell, in order to expose to view certain components that would otherwise be concealed.

Referring now to the drawings, FIG. 1 shows a relatively shallow oil well denoted generally by the reference numeral 10. The surface or ground level has been denoted by the numeral 12. Extending vertically downwardly from the surface 12 is a bore hole 14. Of interest to the practicing of the present invention is a layer of oil-bearing sand 16 customarily referred to as the pay zone.

As is conventional, the oil well 10 includes a well casing 18 having an open lower end 20 and production tubing 22 extending upwardly therethrough. By means of a pump (not shown) at the ground level 12, the accumulated fluid is raised or pumped upwardly. The pump, it will be appreciated, is a so-called walking beam type of pump which is also known as a horsehead pump having a sucker rod 24 that is raised and lowered. It is not thought necessary to describe the pump in any detail. The elevated fluid that is pumped up through the production tubing 22 is then directed via lateral piping 26 and a flow meter 27 for monitoring the flow of fluid to a storage facility 28. The reason for determining the rate of fluid flow will be explained later.

The system exemplifying my invention has been indicated generally by the reference numeral 30. While, in a sense, it includes the conventional production tubing 22, the system 30 will be described as basically including a microwave transmission line 32 that is coupled to an encapsulated antenna or radiator unit 34 through the agency of a transition header 36 owing to the close association of the production tubing 22 with the transmission line 32, particularly as related to a waveguide hereinafter more fully described, the production tubing 22, as already indicated, may be considered to be an integral component of the system 30.

Supplying microwave power in the system 30 is a radio frequency generator 38 located on the surface 12, being in the form of a conventional magnetron or klystron. A separately denoted feeder line 42 connects the output from the generator 38 to the microwave transmission line 32, although in practice the line 42 would simply be an integral portion of the transmission line 32. It will be observed that there is a gas supply 46 that supplies an inert gas, such as nitrogen, to the interior of the coaxial transmission line 32. Thus, the interior of the transmission line 32 is maintained at a pressure somewhat higher than the ambient pressure, thereby not only preventing arc-overs but also preventing the flow of any liquids or gases from the surrounding terrain into the interior of the radiator unit 34.

Associated with the radio frequency generator 38 is an excitation control device 48. The control device 48 is under the supervisory control of a computer 56 which receives control signals from an interface 58 that mates the various telemetering lines 60 and 62, which extend upwardly through test or probe holes 66, to the computer 56. The holes 66 have relatively small diameter casings 68. Beneath each of the casings 68, so as not to be shielded thereby, is an electromagnetic detector or sensor 70 that simply monitors the amount of microwave energy reaching the underground location where that particular sensor 70 is situated. The computer 56, because of the individual telemetering lines 60, 62 connected thereto through the agency of the interface 58, can control the degree of excitation supplied to the radio frequency generator 38, or the computer 56 can integrate the various telemetered signals so as to provide a composite signal for the generator 38. In this way, the amount of generated microwave energy can be controlled in accordance with the particular characteristics of subterranean layer or pay zone that has been denoted by the reference numeral 16.

Figure 2:
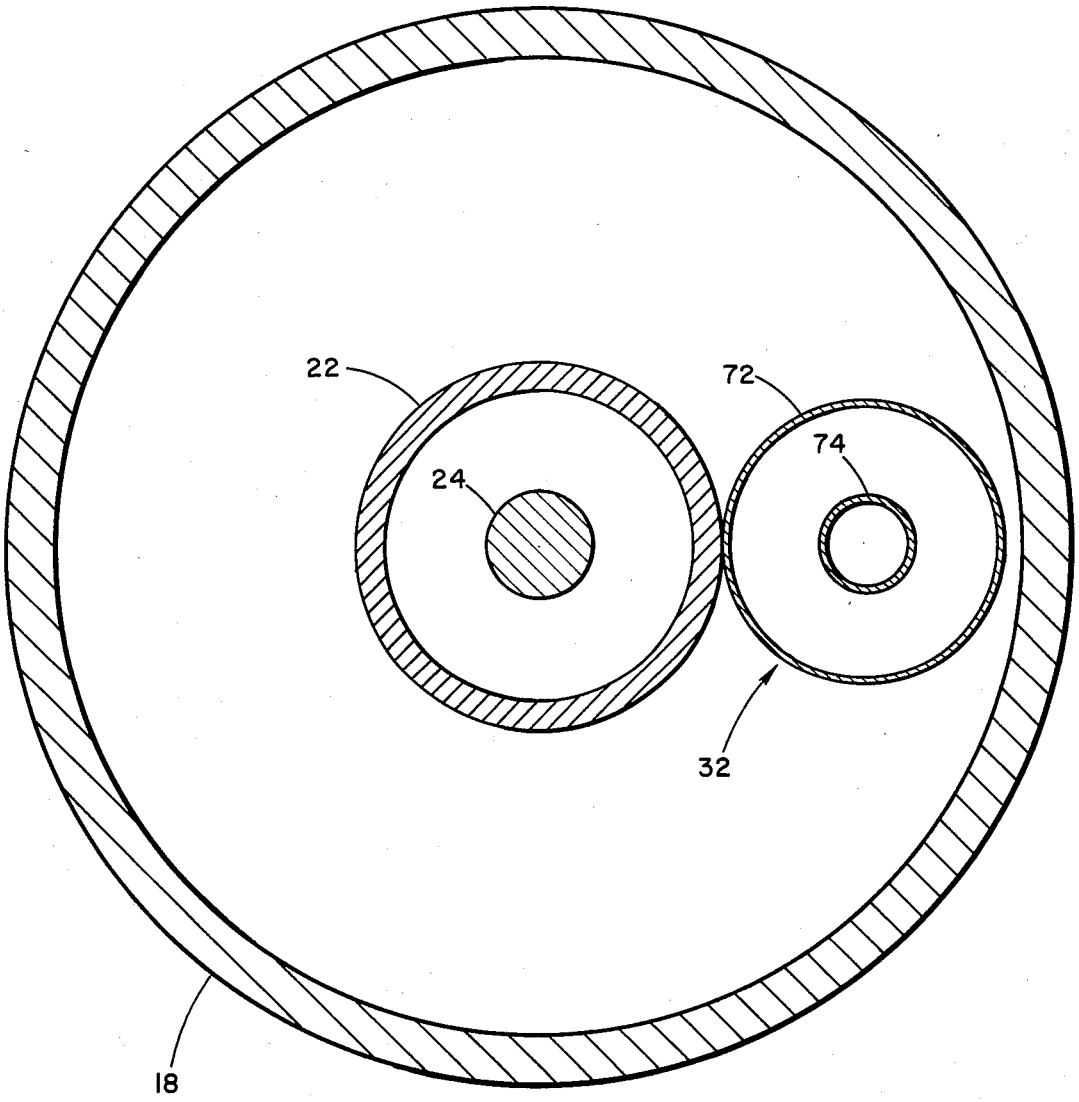
FIG. 2 is a greatly enlarged cross section, the view being taken in the direction of line 2—2 of FIG. 1 to show in a general way the production tubing and the coaxial transmission line in relation to the surrounding well casing of FIG. 1.

From FIG. 1, it will be observed that the coaxial transmission line 32 parallels the production tubing 22 down to the header 36, and from FIG. 2 is can be seen that the transmission line 32 is comprised of an outer metal cylinder or sleeve 72 and a central conductor or tubular rod 74. The header 36 includes generally vertical struts 78 with passages or openings 80 therebetween so that fluid comprised of petroleum that has been heated can enter the production tubing 22 and be pumped upwardly therethrough by the sucker rod 24. Therefore, the upper end of the header 36 includes a disk 82 into which the lower end of the production tubing 22 is threadedly connected. At the lower end of the header 36 is a cup-shaped unit 84, the unit being inverted so that the lower end of the coaxial transmission line 32 extends through its disk-like top 86 into the cylindrical region formed by a depending threaded skirt 88.

Referring now in detail to the antenna or radiator unit 34, it will be seen that this unit is in the form of a capsule denoted generally by the reference numeral 90. The capsule 90 is comprised of an outer cylindrical shell 92 of suitable dielectric material, such as fiberglass, which is reasonably pervious to the passage of microwave energy therethrough. Whereas the upper end of the fiberglass shell 92 is threadedly secured within the threaded skirt 88 of the inverted cup-shaped member 84, the bottom end of the shell 92 is closed by means of a steel bull plug 94 that is threaded into the lower end of the shell 92. The shell 92 must be of sufficient thickness in order to withstand the gas pressures that are apt to be exerted thereagainst. While the thickness of the fiberglass shell 92 must be adequate to withstand whatever pressure that is encountered, its wall should not be any thicker than necessary, for fiberglass has a certain finite dissipation or loss as far as microwave energy is concerned. The thickness can be lessened by introducing an inert gas, such as via the nitrogen supply 46, so as to create an internal positive pressure within the shell 92.

Figure 3:
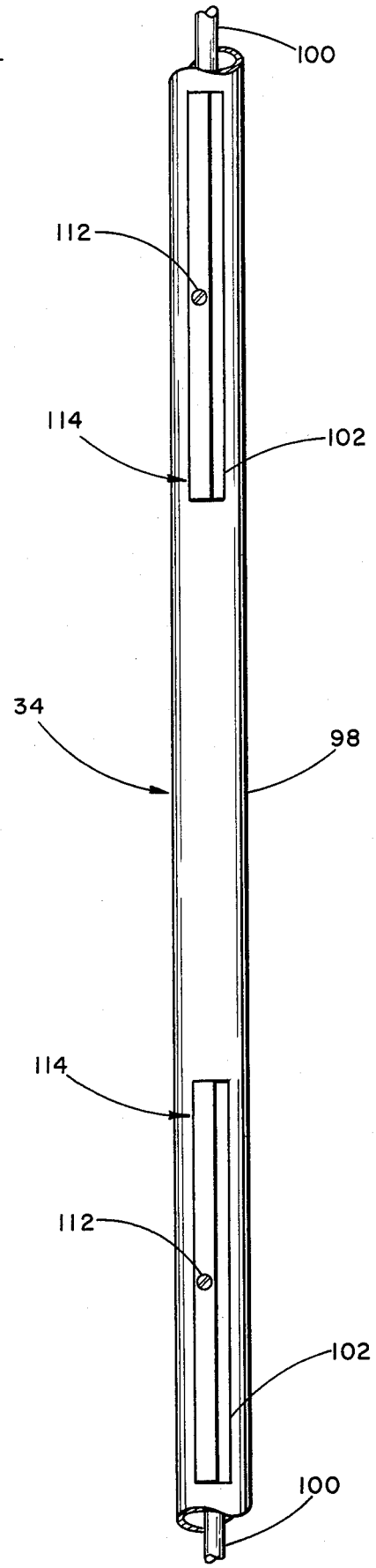
FIG. 3 is a fragmentary vertical detail of the radiating unit for the purpose of showing two of the radiating slots, the view being taken in the direction of line 3—3 of FIG. 1.

As can be seen in FIG. 3, the radiating unit 34 consists of an outer conductor 96 comprised of a metal cylinder 98, preferably of copper, having a $1\frac{5}{8}$ inch outside diameter. Within the cylinder 98 is a centrally located conductor in the form of a tube 100, here again, of copper, having a wall thickness approximately the same as the outer cylinder 98.

The cylinder 98 is provided with a number of vertically oriented resonant slots 102, each slot 102 having a vertical length roughly equal to three-fourths of a wavelength (nine inches) at a frequency of 915 megahertz. The width of each slot 102 is 0.25 inch, the width across the slot 102 determining the impedance thereof. The number of slots 102 is determined by the type of oil-bearing strata, mainly as to whether the strata is sufficiently rich with petroleum so as to warrant the propagation of microwave energy outwardly into the region so as to heat the media sufficiently to produce fluid flow. The pay zone is exemplified by the oil-bearing sand 16 in FIG. 1. The distance between slots 102 measured in a vertical direction is on the order of one wavelength (thirteen inches).

Figure 4:
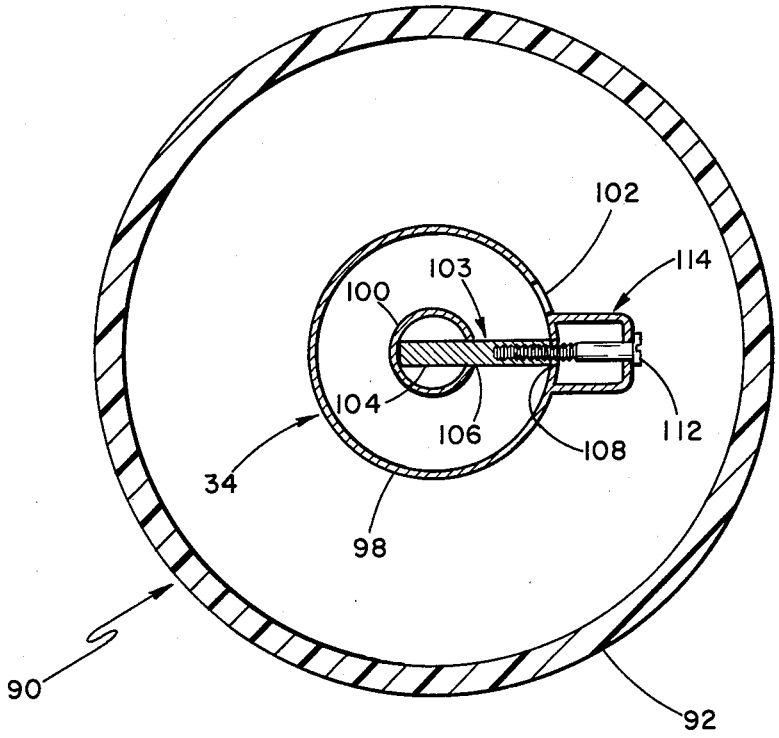
FIG. 4 is a cross sectional view through the radiating unit in the direction of line 4—4 of FIG. 1.

There is an appropriate shorting device 103 associated with each slot 102. As can be discerned from FIG. 4, there is a radially disposed plug 104 of copper or brass that functions as an electrical short, one end of the plug 104 extending into the tubular conductor 100 via a circular opening 106 and the outer end of the radial plug 104 being innerjacent the periphery of a circular opening 108 in the cylinder 98. The shorting plug 104 is held in place by a bolt 112 associated therewith so as to enhance the impedance match of the radiating unit. In this way, the frequency, phase and amplitude of the microwaves that would be propagated through the slots 102 in each instance is electrically correlated with the particular characteristics of the underground oil-bearing formation, such as that labeled 16. It will be appreciated that core samples are taken when initially drilling the bore hole 14 so the various devices 103 can be individually tuned for the particular character of the strata that is to be encountered at a given depth by selecting the proper dimensions for the plug 104.

As a practical matter, when the periphery of a given cylinder 98 is not adequate, the various slots 102 become infinitely long and will not radiate microwave energy. Although the radiating unit 34 projects downwardly beneath the lower end of the well casing 18, it will be recognized that the unit 34 must be of a cross section such as to pass downwardly through the interior of the well casing 18. It should be understood that there are dimensional restrictions imposed upon the cross section of the radiating unit 34. Hence, in order to effectively increase the overall periphery from the positive side of each slot 102 to the negative side thereof, the invention envisages the employment of an accessory denoted generally by the reference numeral 114. The box-like structure or accessory 114 is U-shaped when viewed in cross section, thereby adding very little mass and weight to the antenna or radiator unit 34. As can be learned from FIG. 4, the accessory 114 has side wall dimensions extending radially about 0.5 inch and a similar dimension as far as the closed end of the U-shaped structure 114 is concerned. Hence, the effective length or peripheral distance is increased by reason of the rectangular configuration of the U-shaped accessory 114. The U-shaped accessory 114 is disposed adjacent each slot 102 and has a length (nine inches) coextensive with the slot 102 with which it coacts. The nub of the matter is that without the increased peripheral distance, the circumference, and hence the diameter, of the metal cylinder 98 would have to be increased to such an extent that the coupling flanges (not illustrated) thereon would require that the diameter of the shell 92 be correspondingly increased so that the capsule 90 would not pass downwardly through the well casing 18.

Figure 5:
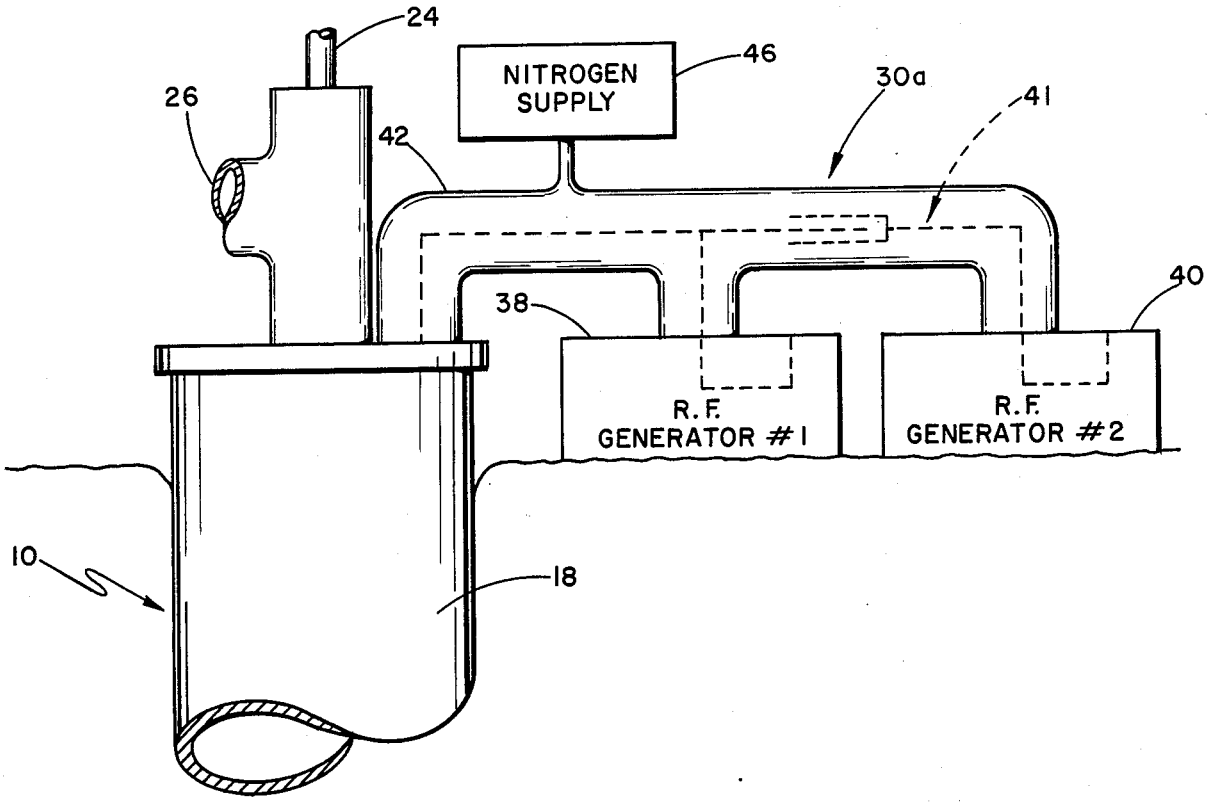
FIG. 5 is a fragmentary view generally similar to the upper portion of FIG. 1, the view in this instance, however illustrating the use of two radio frequency generators.

My system 30 is indeed quite versatile with respect to the particular frequency or frequencies to be employed. For instance, if the generator 38 is providing microwave energy at 915 megahertz, a second generator 40 can provide, say, microwave energy at 305 megahertz. The second generator 40 appears in FIG. 5, and the two-generator system has been distinguished from the single generator system 30 by the suffix "a". The higher frequency, that is 915 megahertz which is commonly adopted and used, will produce very good penetration with respect to the distance the microwave energy travels through the underground formation 16. On the other hand the lower frequency microwave energy will travel even farther, thereby providing a greater degree of penetration. If these two frequency signals are transmitted simultaneously, what develops is a simulated gravity drive system because two different temperatures are produced. Inasmuch as the higher frequency microwave energy does not penetrate as far as the low frequency energy, a higher temperature and hence a lower viscosity is produced in a region nearer the antenna or radiating unit 34. This provides a path of freer flow for the fluid so that the difference in viscosity and the greater freedom of flow nearer the antenna or radiating unit 34 will create a simulated gravity drive system which more effectively removes the fluid usually containing both petroleum and water. In order to couple the two generators 38 and 40 to the upper end of the coaxial transmission line 32, a coupling system 41 is employed which is diagrammatically illustrated in phantom outline in FIG. 5.

To further demonstrate the versatility of my system 30, it is possible to have the radiating unit 34 comprised of two vertically oriented sections that would hang with respect to each other in a tandem fashion. For instance, the upper section of such an antenna array might propagate microwave energy at 915 megahertz, whereas the lower section that depends from the upper section would function at 2,745 megahertz, three times the basic frequency (in contradistinction to the above-referred to one-third relationship). Consequently, the system would be radiating at two frequencies into the pay zone 16 inasmuch as the antenna could be divided into vertical frequency-tuned sections or lengths rather than a single monochromatic frequency structure. Thus, one section or length would be propagating energy at the basic frequency of 915 megahertz and would also be radiating energy at 2,745 megahertz (or two tandem sections could radiate these two frequencies).

While the miniaturization that has been described, both as related to the antenna or radiator unit 34 and also the capsule 90, it is important to recognize that the telemetering aspect of the system 30 is important as far as effecting an optimum petroleum return for the amount of energy that is radiated. Thus, the various test bores 66, which are at different distances from the radiating unit 34 and generally located at the same depth as the unit 34, will sense the amount of energy arriving at that particular location. By telemetering the derived signals to the surface 12, the computer 56 can be programmed to process those signals so as to control the excitation device 48 so that the radio frequency generator 38 produces the requisite amount of power to assure a sufficient temperature, and hence enough heat, at various locations outwardly from the radiating unit 34. Although omitted from FIG. 5, the generator 40 has an excitation device and it will be recognized that either or both of the excitation devices for the two generators can be used, depending upon whether a single frequency is employed or whether a dual frequency is used.

It is not necessary, whether utilizing two frequencies or just one frequency, to radiate microwave energy continuously. Actually, the radio frequency generator 38 can be turned on and off so as to radiate energy into the subterranean layer 16 for a selected period and then cease all radiation so that the effect derived from the radiated energy will then produce a latent flow of fluid usually substantially greater than that derived from a continuous radiation of microwave energy. This is a phenomenon that is very effective in achieving the greatest amount of petroleum for a given amount of energy. It will be recognized that the fluid may be a composite of oil and water. Thus, when radiating for a period of a week or even a month, a certain amount of fluid will gravitationally flow to the open lower end 20 (which is just below the non-illustrated pump seat) of the well casing 18 so that it will then be pumped through the production tubing 22 by the sucker rod 24 into the storage facility 28. However, when the generator 38 is turned off, the flow for several days thereafter usually is substantially increased. This is preferably done with a single frequency provided by the radio frequency generator 38 (or the generator 40). The on and off periods as far as radiation is concerned are susceptible to empirical determination. This is simply achieved by monitoring the fluid flow to the storage facility 28 through the agency of the flow meter 27.

Figure 6:
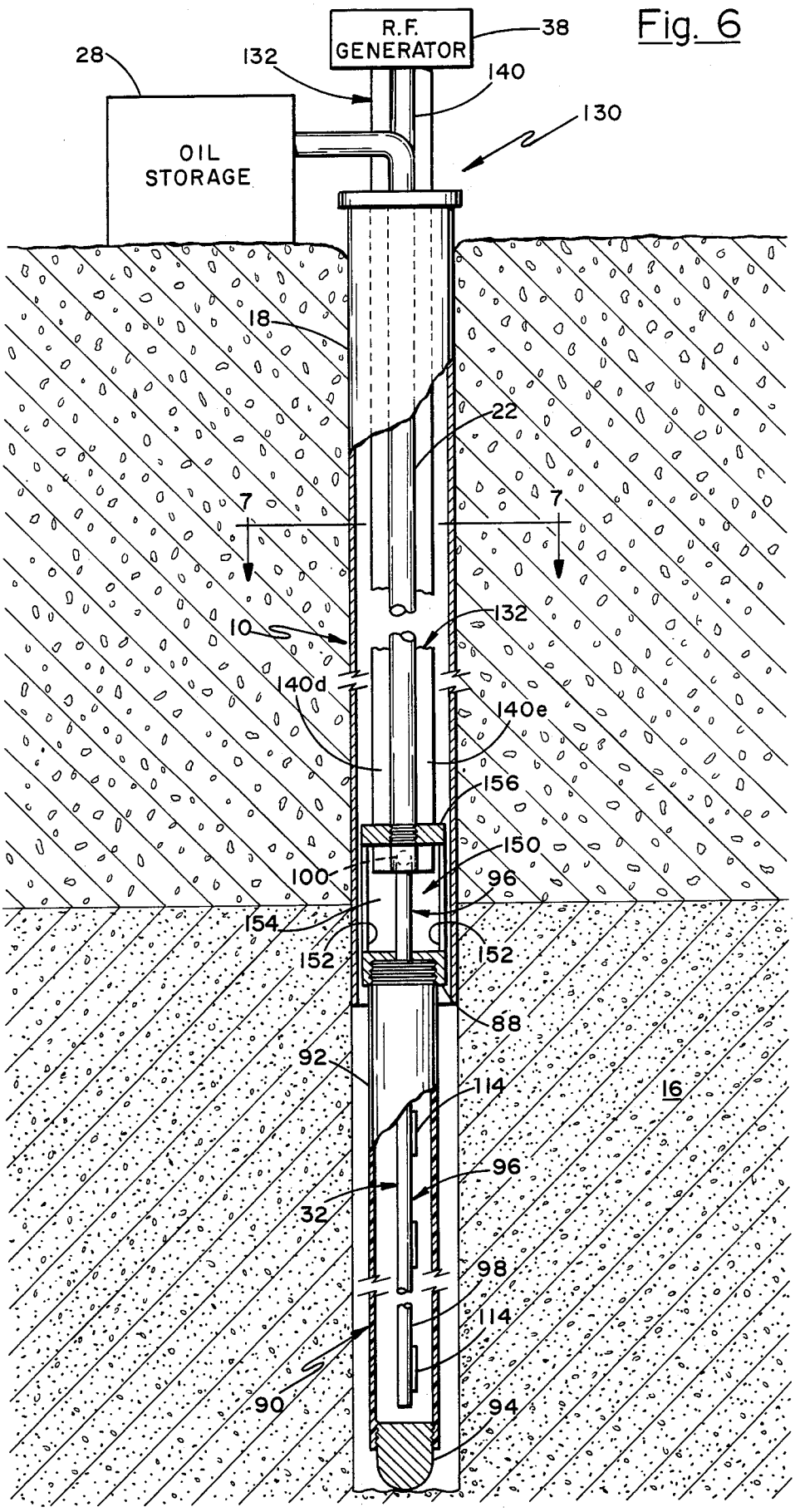
FIG. 6 is an elevational view of a modified system exemplifying my invention, the embodiment in this instance including a special waveguide, in contradistinction to the coaxial transmission line of FIG. 1, for transmitting microwave power to the slotted radiating unit therebelow, the slotted radiating unit, however, being the same as in FIG. 1.

Before describing the system 130 of FIG. 6, it should be pointed out that the restrictive size of most oil wells make it such that a coaxial transmission line can become impractical because it cannot be made large enough to provide low attenuation when the microwave energy is to be transmitted over a considerable distance. In this regard, for example, if the oil well 10 should extend into the ground approximately 1,000 feet, a considerable loss would be incurred in that great a distance when using a coaxial transmission line, such as that labeled 32 in FIG. 1. Waveguide structures, if properly designed, can decrease the transmission line loss by a factor of 100, or even 1,000, compared to what would occur by using a coaxial transmission line. It should be borne in mind that a frequency of 915 megahertz happens to involve a wavelength approximating thirteen inches. This would require a half wavelength of about six inches, a dimension that is entirely too large for most oil wells. Thus, in order that a suitable system be adaptable to a typical oil well, it becomes necessary to miniaturize the overall dimensions of the waveguide to such an extent that it can fit within the normal well casing 18.

Figure 8:
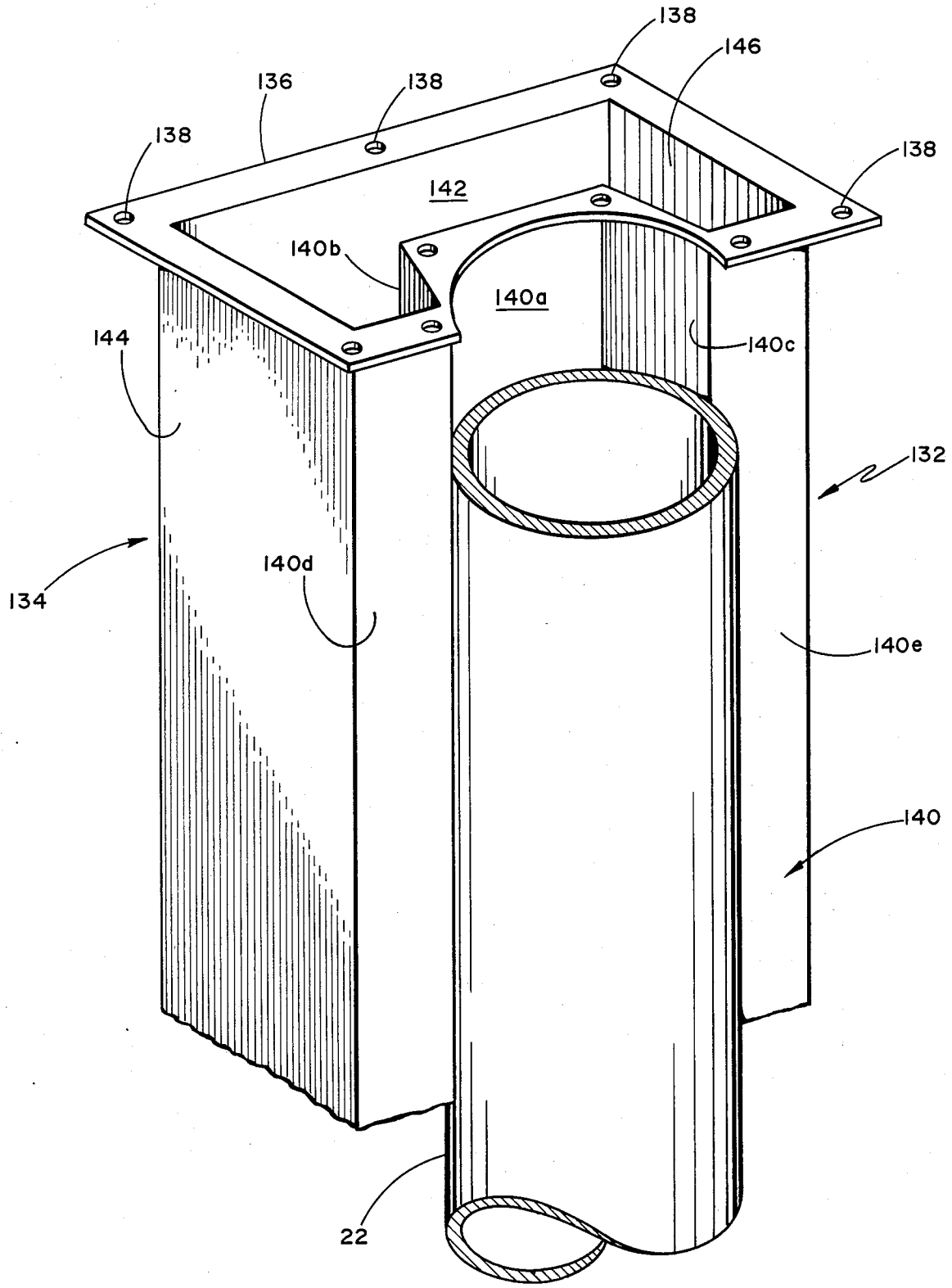
FIG. 8 is a fragmentary perspective view of one waveguide unit with a longitudinal portion of the production tubing shown in conjunction therewith.

Describing now the system 130 illustrated in FIG. 6, which includes a number of indentical components contained in the system 30 and which will be assigned the same reference numerals, it is to be noted that the system 130 comprises a waveguide indicated generally by the reference numeral 132. It will be appreciated that the waveguide 132 is composed of any preferred number of identical waveguide units 134, each unit 134 having a flange 136 (FIG. 8) at its upper and lower ends so that the units 134 can be mechanically connected together by means of bolts (not shown) that are readily inserted through the various holes 138 (FIG. 8) in the flanges 136.

To couple the microwave energy to the lower end of the waveguide 132 to the upper end of the coaxial line 96 in the embodiment of FIG. 6, the upper end of the tube 100 is curved sufficiently so as to connect with the rear wall 142 of the lowermost unit 134 of the waveguide 132.

Figure 7:
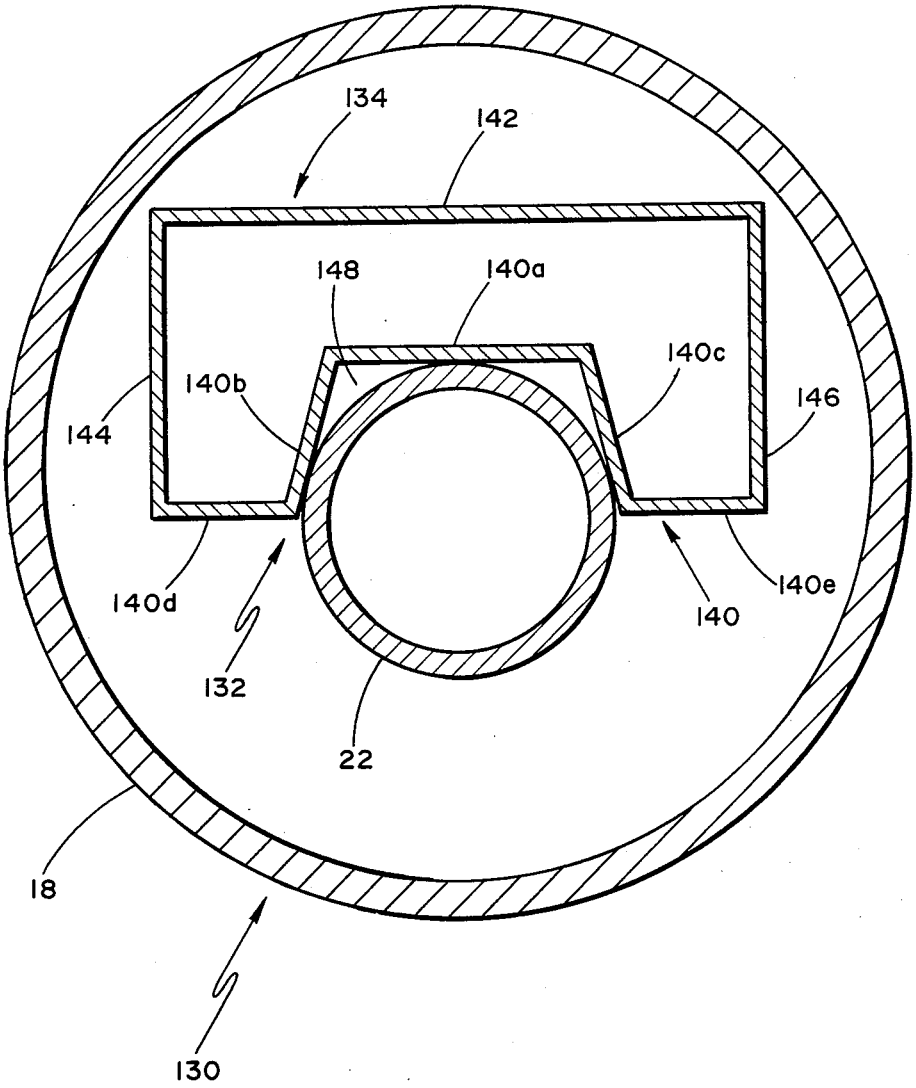
FIG. 7 is a horizontal view taken in the direction of line 7—7 of FIG. 6 for the purpose of showing how a semicircular portion of the production tubing is nestingly received in a groove formed in one wall of the waveguide, the sucker rod being omitted.

From FIG. 7, it will be discerned that each unit 134 includes a front wall 140, a rear wall 142, and laterally spaced side walls 144 and 146. See FIG. 8 also, as can readily be observed from FIG. 7, the waveguide cross section is only generally rectangular. In this regard, the front wall 140 is comprised of a first panel portion 140*a* diverging panel portions 140*b*, 140*c* and forwardly disposed panel portions 140*d*, 140*e*. It will be appreciated that the panel portion 140*a* resides in a plane parallel to the rear wall 142, and the forwardly disposed panel portions 140*d* and 140*e* reside in a common plane that is not only parallel to the panel portion 140*a* but also parallel to the rear wall 142. The particular cross sectional configuration of the panel portions 140*a*, 140*b*, 140*c*, 140*d* and 140*e* contributes additional capacitance to the waveguide 132 in an amount sufficient to reduce considerably the physical size of the waveguide 132. In other words, the adding of capacity across the waveguide 132 where the highest field strength exists, that is, at the center between the panel portion 140*a* and the rear wall 142 enables the dimensions of the waveguide 132 to be sufficiently reduced so as to be accommodated in a typical well casing 18 as can readily be seen from FIG. 7. A conventional waveguide structure having a truly rectangular cross section, when used to transmit microwave energy at 915 megahertz, could be on the order of six inches by three inches. For whatever frequency is employed, the dimensions of the waveguide 132 it will be understood, can be substantially reduced when practicing the teachings of my invention.

One nicety about my invention is that not only are the dimensions of the waveguide 132 reduced to acceptable sizes, as outlined above, but a groove 148 is formed in the front wall 140 by virtue of the panel portion 140*a* and the diverging panel portions 140*b* and 140*c*. Approximately half the cross section, constituting a semicircle, of the production tubing 22, in this way, resides within the confines of the groove 148. The tubing 22 and waveguide 132 are held together by means of appropriate clamps or flexible straps (not shown). In this way, the waveguide 132, while fairly rigid in and of itself, is rendered even more rigid by the inclusion and retention of the production tubing 22 in the groove 148. Stated somewhat differently, production tubing, such as that labeled 22, can present sway problems in actual practice, especially where relatively long lengths of tubing are employed. In the past, it has been common practice to utilize centralizers so as to prevent undue lateral movement of extremely long stretches of production tubing. However, with the composite structure formed by the waveguide 132, namely, with the production tubing 22 nested within the groove 148 formed in the front wall 140, the rigidity of the composite structure is considerably increased. It should also be taken into account that when the tubing 22 is strapped (or otherwise clamped) in the groove 148 peripheral segments of the tubing 22 engage portions of the wall 140. For instance, the straps can very well force the tubing 22 against the panel portion 140*a* of each of the waveguide sections 134. At the same time, a segment of the production tubing 22 can be caused to bear or contact one of the diverging walls 140*b* or 140*c*. It is possible to have the dimensions of the panel portions 140*a*, 140*b*, 140*c*, and the degree of divergence of the portions 140*b*, 140*c*, such that the production tubing 22 contacts all three portions 140*a*, 140*b* and 140*c*. However, it is not necessary to fabricate the waveguide units 134 so precisely. The point to be appreciated is that there is physical engagement of the production tubing 22 at angularly spaced longitudinal locations so that good thermal conductivity exists between the tubing 22 and the waveguide 132. Consequently, the configuration just described for the waveguide 132 is instrumental in causing heat to be conducted from the waveguide 132, through the cylindrical wall of the tubing 22 and into the fluid flowing upwardly through the production tubing 22, thereby causing the waveguide 132 to rid itself of some of the heat that should be removed in order to keep the waveguide 132 at appropriately low levels of temperature when carrying considerable microwave power.

As far as the header labeled 150 is concerned, it need only be generally referred to. The purpose thereof, as is believed evident, is to provide a means for coupling the microwave energy transmitted through the waveguide 132 of the system 130 into the upper end of the antenna or radiator unit 34, the unit 34 being the same in both systems 30 and 130. Basically, the header resembles the header 36 in its construction in that it includes a pair of struts 152 having access openings 154 therebetween through which the heated petroleum can flow. An upper disk 156 has an opening formed therein for the accomodation of the lower end portion of an unflanged waveguide unit 134. The radiator unit 34, which is a coaxial device, extends upwardly and then curves rearwardly so as to connect with the interior of the lower portion of the waveguide 132, doing so through the flat rear wall 140. In this way a waveguide to coaxial transition is effected. It will be understood that once the relatively unattenuated microwave energy is delivered to the radiator unit 34 from the waveguide 132, the propagation of such energy through the slots 102 is the same as when employing the system 30. It cannot be overly stressed that the system 130 possesses a minimal loss effect that proves exceptionally valuable where relatively deep wells are encountered.

Figure 9:
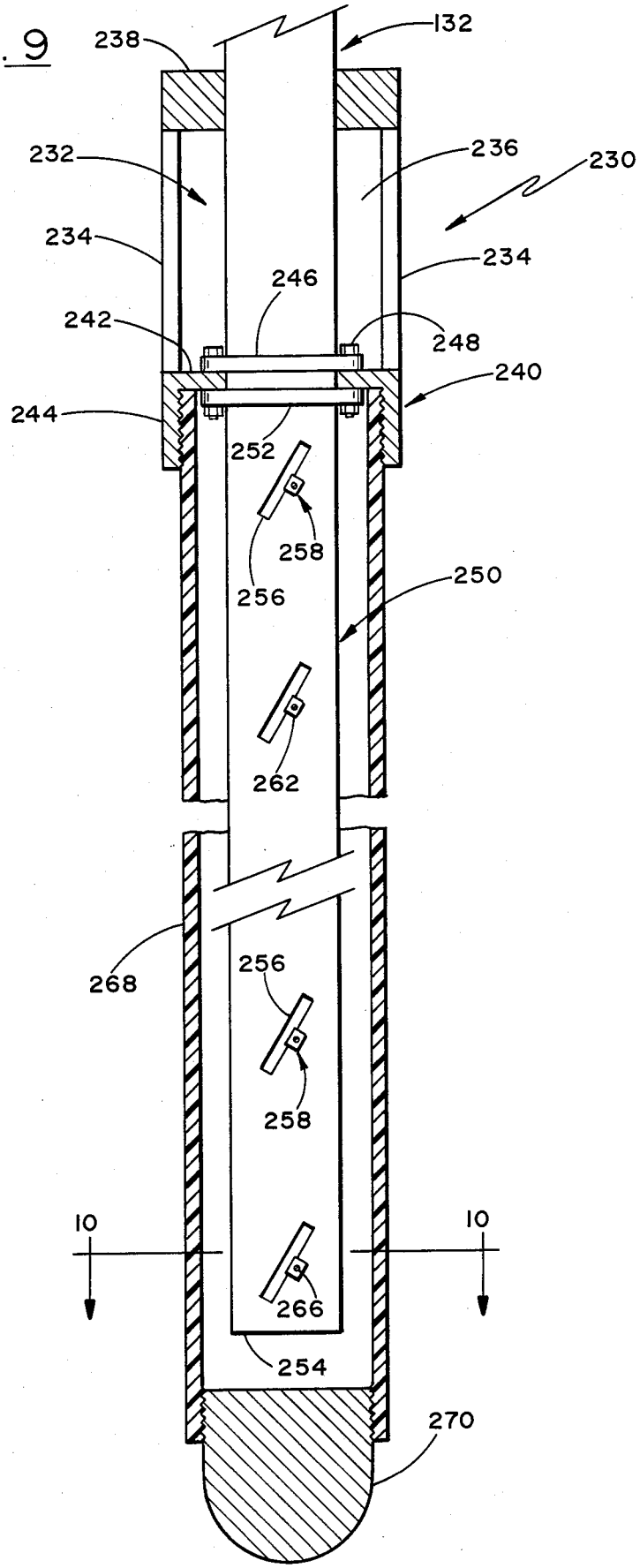
FIG. 9 is an elevational view of a different radiating unit from that depicted in FIGS. 1 and 6 having the same cross sectional configuration as the waveguide of FIG. 6 but provided with a series of angled slots used in the propagation of the microwave energy transmitted downwardly via the waveguide of FIG. 6.
Figure 10:
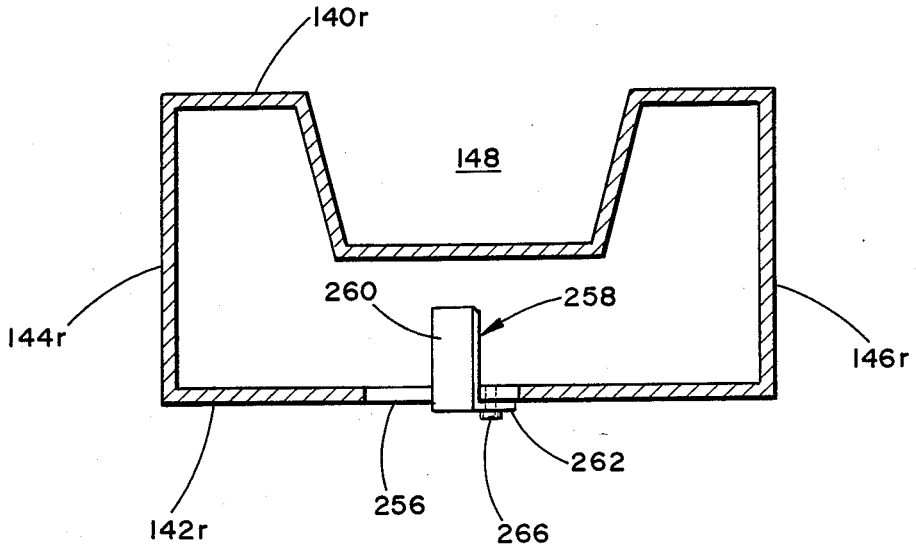
FIG. 10 is a horizontal cross section of the radiating unit of FIG. 9, the view being just above one of the slot probes and in the direction of line 10—10 of FIG. 9.

In referring to FIG. 9, it is important to understand that in the system 230 appearing in FIG. 9 the transmission means is the same as that employed in the system 130 of FIG. 6, but that the waveguide 132 is turned through 180°. Stated somewhat differently, FIG. 9 can be considered a rear view. Hence, one sees the lower portion of the flat wall 142 in FIG. 9 rather than the front wall 140.

In this instance there is a header 232 much like the headers 36 and 150. Thus, there are a pair of struts 234 with access openings 236 therebetween so that the heated petroleum can flow into the region beneath the lower end of the production tubing 22 that is nested in the groove 148 (not visible in FIG. 9 because it is on the far side of the waveguide 132 which has been rotated through 180° from that in which it is seen in FIG. 6, as already explained). An upper disk 238 has an opening therein which is shaped to accommodate the cross section of the waveguide 132. A lower cup-shaped member 240 has a disk-like top 242 and an internally threaded cylindrical skirt 244. The top 242 has an opening corresponding in shape to that in the upper disk 238 for receiving therein the extreme lower end of the waveguide 132. A flange 246 fastened to the waveguide 132 just above its lower end enables the waveguide 132 to be anchored to the disk 238 by means of bolts 248.

The radiator unit, indicated generally by the reference numeral 250, differs considerably from the radiator unit 34 employed in the systems 30 and 130. In the present embodiment, the radiator 250 basically resembles the waveguide 132 but rendered capable of propagating microwave energy in a manner soon to be described. It should be pointed out that the waveguide 132, more specifically the various units 134 comprising same, can be extruded, which provides a saving as far as fabrication costs are concerned. The same holds true for the radiator 250. Inasmuch as the cross section of the radiator 250 is the same as the waveguide 132 it may help to simply add the suffix "r" to the various walls and panel sections previously identified when describing the waveguide 132.

Accordingly the radiator 250 includes a rear wall **140*r* (corresponding to the front wall 140 in FIG. 6), a front wall 142*r* (corresponding to the rear wall 142 in FIG. 6), laterally spaced side walls 144*r*, 146*r* and groove 148. The upper end of the radiator 250 has a flange 252 attached thereto so that the bolts 248, when tightened, connects the radiator 250 to the waveguide 132 to establish communication between the lower end of the waveguide 132 and the radiating unit 250. The lower end of the radiator 250 is closed by a plate at 254**.

It will be observed from FIG. 9 that the wall **142*r* has a series of angled slots 256 formed therein, the slots 256 being at an angle of approximately 30° with respect to a vertical line. Although at a fixed angle or tilt, the optimum angle is determined so as to achieve the best possible radiation. The lowermost slot 256, it can be pointed out, is one-quarter wavelength above the bottom plate at 254** which functions as an electrical short.

Figure 11:
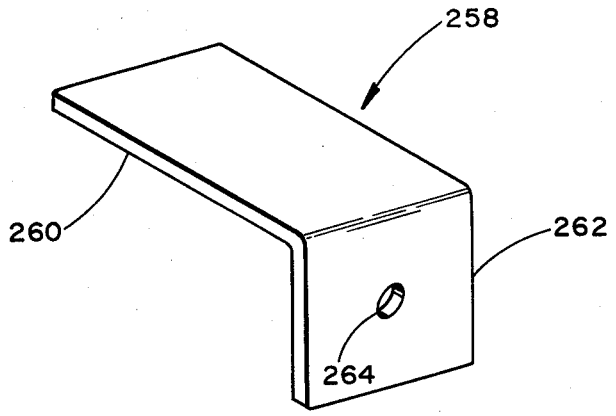
FIG. 11 is a perspective detail of a probe used in association with each of the angled slots.

Each slot 256 has associated therewith a metal probe 258. As can be discerned from FIG. 11, the probe 258 is L-shaped, having a relatively long leg 260 and a relatively short leg 262. The relatively short leg has a hole 264 therein so that it can be attached to the wall **142*r* by a screw 266 so that the leg 262 projects into the interior of the radiator 250. Inasmuch as there is one probe 258 for each slot 256, the slots 256 collectively radiate the microwave energy transmitted downwardly by the waveguide 132 into the upper end of the radiator 250. The various probes 258 intersect the energy as it travels downwardly, so as to extract a percentage thereof, the extracted energy radiating outwardly via the slots 256**.

As with the radiating unit 34, the unit 250 is encapsulated in a radio frequency permeable cylindrical shell 268, the upper end of the shell 268 being threaded into the skirt 244. A bull plug 270 seals the lower end of the shell 268 in the same manner as the plug 94 closes the lower end of the shell 92.

From the foregoing it should be evident that my invention is exceedingly versatile, lending itself readily to various well depths and different types of petroleum-impregnated media. It is especially important to appreciate that the relatively small inside diameters of the casings now being used, while reducing costs due to the reduced size, have imposed substantial restraints on oil reclamation projects, restraints that are obviated when practicing my invention. It will be recognized that once the radiating unit 34 or 250 has been inserted into the well casing 18, successive sections of tubing 22 and successive units 134 of the waveguide 132 are lowered. Where the transmission line is a coaxial line 32, it can be easily unrolled from a reel as it is fed downwardly. By the same token, the above-alluded to components can be reused, only a reversal of the installation process being needed. As indicated, but not illustrated, the production tubing 22 can be strapped to either the coaxial line 32 or the waveguide 132, both to rigidify the combination and to promote a thermal transfer therebetween. More accurately, it perhaps should be stated that the coaxial line 32 or the waveguide 132, as the case may be, is strapped to the tubing 22, for the gauge of the tubing is greater.

I claim:

1. An oil recovery system comprising a well casing, means within said casing for conducting fluid upwardly through said casing from a subterranean petroleum-bearing formation, means externally located with respect to said casing for generating microwave energy, means within said casing for transmitting said microwave energy downwardly within said casing from said externally located generating means, and a radiator unit connected to the lower end of said transmitting means having a plurality of vertically spaced slots therein, said slotted radiator unit projecting beneath the lower end of said casing for propagating at least some of said microwave energy into said subterranean formation via said slots.

2. An oil recovery system in accordance with claim 1 in which said microwave transmitting means includes a coaxial transmission line.

3. An oil recovery system in accordance with claim 2 in which said fluid conducting means includes production tubing through which the fluid flows and said coaxial transmission line extends in a parallel relation with said tubing.

4. An oil recovery system in accordance with claim 3 in which said tubing is metal and said coaxial transmission line includes a metal cylinder having a portion thereof engaging a portion of said metal tubing.

5. An oil recovery system in accordance with claim 1 in which said microwave transmitting means includes a waveguide.

6. An oil recovery system in accordance with claim 5 in which said tubing is metal and said waveguide includes a metal wall having a portion thereof engaging a portion of said metal tubing.

7. An oil recovery system in accordance with claim 1 in which said slots are vertically oriented.

8. An oil recovery system in accordance with claim 1 in which said radiator unit includes a waveguide, said slots being located in said waveguide.

9. In a system for in situ heating underground hydrocarbonaceous material via a bore hole of restricted cross section, a waveguide having a width somewhat less than that of the bore hole, said waveguide having a longitudinal groove in one wall thereof, and tubing received in said groove and extending therealong.

10. A system in accordance with claim 9 in which said tubing engages said one wall along one side of said groove.

11. A system in accordance with claim 10 in which said groove has diverging sides, said tubing engaging one of said diverging sides.

12. A system in accordance with claim 11 in which said slots are oriented at an angle.

13. A system in accordance with claim 9 in which said waveguide has a plurality of vertically spaced slots in one wall thereof.

14. A system in accordance with claim 13 in which said angle is approximately 30° with respect to the longitudinal axis of the waveguide.

15. An oil recovery method comprising the step of disposing production tubing and a radio frequency transmission line in a well casing, at least portions of said tubing and said transmission line being in engagement, said transmission line including a waveguide having a plurality of vertically spaced slots therein.

16. An oil recovery method comprising the steps of radiating microwave energy into a petroleum-bearing subterranean formation for a first period of time, discontinuing the radiating of any microwave energy into said subterranean formation for a second period of time, determining the rate of fluid flow resulting from the radiation of microwave energy into said subterranean formation, and discontinuing the radiation of said microwave energy after a first rate of fluid flow has been determined.

17. An oil recovery system comprising a well casing, means within said casing for conducting fluid upwardly through said casing from a subterranean petroleum-bearing formation, said fluid conducting means including metal tubing through which the fluid flows, means within said casing for transmitting microwave energy downwardly within said casing including a waveguide provided with a metal wall having a portion thereof engaging a portion of said metal tubing, said wall having a groove therein and a portion of said tubing residing in said groove, and a radiator unit connected to the lower end of said transmitting means having a plurality of slots therein, said slotted radiator unit projecting beneath the lower end of said casing for propagating at least some of said microwave energy into said subterranean formation via said slots.

18. An oil recovery system in accordance with claim 17 in which said one wall includes first, second and third panel sections, said second and third panel sections diverging from said first panel section to form said groove.

19. An oil recovery system in accordance with claim 18 in which said one wall additionally includes a fourth panel section extending from said second panel section in a parallel relation with said first panel section, and a fifth panel section extending from said third panel section in a parallel relation with said first panel section.

20. An oil recovery system in accordance with claim 19 in which said tubing has a circular cross section and said fourth and fifth panel section reside in a plane passing generally diametrically through the center of said tubing.

21. An oil recovery system in accordance with claim 19 in which said waveguide includes second, third and fourth walls, said second wall being in a spaced parallel relation with said first, fourth and fifth panel sections, and said third and fourth walls being parallel to each other and perpendicular to said second wall and also perpendicular to said fourth and fifth panel sections.

22. An oil recovery system in accordance with claim 18 in which said tubing is in engagement with at least one of said first, second or third panel sections.

23. An oil recovery system in accordance with claim 17 in which said waveguide includes a plurality of individual units, each unit having a flange for enabling attachment of one unit to the next unit to form a vertical string of such units.

24. An oil recovery system comprising a well casing, means within said casing for conducting fluid upwardly through said casing from a subterranean petroleum-bearing formation, means within said casing for transmitting microwave energy downwardly within said casing, a radiator unit connected to the lower end of said transmitting means having a plurality of slots therein, said slotted radiator unit projecting beneath the lower end of said casing for propagating at least some of said microwave energy into said subterranean formation via said slots, and first and second radio frequency generating means connected to the upper end of said transmitting means, said first generating means supplying microwave energy at a relatively high frequency and said second generating means supplying microwave energy to said radiator unit at a relatively low frequency.

25. An oil recovery system in accordance with claim 24 in which said relatively high frequency is on the order of 915 megahertz and said relatively low frequency is on the order of 315 megahertz.

26. An oil recovery system comprising a well casing, means within said casing for conducting fluid upwardly through said casing from a subterranean petroleum-bearing formation, means within said casing for transmitting microwave energy downwardly within said casing, a radiator unit connected to the lower end of said transmitting means having a plurality of slots therein, said slotted radiator unit projecting beneath the lower end of said casing for propagating at least some of said microwave energy into said subterranean formation via said slots, means for generating said microwave energy, means for causing said radiator unit to propagate microwave energy during a first predetermined period and to cause said radiator unit to discontinue propagating of microwave energy during a second predetermined period, said second predetermined period being longer than said first predetermined period, and means for monitoring the flow of fluid through said tubing during both of said periods.

27. An oil recovery system comprising a well casing, means within said casing for conducting fluid upwardly through said casing from a subterranean petroleum-bearing formation, means within said casing for transmitting microwave energy downwardly within said casing, and a radiator unit connected to the lower end of said transmitting means having a plurality of slots therein, said slotted radiator unit projecting beneath the lower end of said casing for propagating at least some of said microwave energy into said subterranean formation via said slots, said radiator unit including a plurality of vertically spaced, angularly oriented slots.

28. An oil recovery system in accordance with claim 27 in which said radiator unit includes a cylinder, said slots being located in said cylinder, an inner conductor within said cylinder, and a shorting member for each of said slots connecting said conductor to said cylinder at one edge of each slot and adjacent the middle of each slot.

29. An oil recovery system in accordance with claim 28 in which the vertical length of each slot is approximately three-fourths of a wavelength.

30. An oil recovery system in accordance with claim 29 including auxilary means attached to said cylinder at one side of each slot for increasing the peripheral distance from said one edge of the slot to the opposite edge of said slot.

31. An oil recovery system in accordance with claim 30 in which said auxiliary means has a U-shaped cross section.

32. An oil recovery system in accordance with claim 28 in which said auxiliary means has a length corresponding to the length of the slot with which it is associated.

33. An oil recovery system in accordance with claim 30 including a cylindrical dielectric shell in which said slotted cylinder and auxiliary means are encapsuled, said auxiliary means projecting radially from said slotted cylinder toward the interior of said cylindrical shell.

34. An oil recovery method in accordance with claim 27 including the steps of determining the rate of fluid flow during said second period, and again radiating microwave energy into said formation after a second rate of fluid flow has been determined during said second period.

35. An oil recovery system comprising a well casing, means within said casing for conducting fluid upwardly through said casing from a subterranean petroleum-bearing formation, means within said casing and transmitting microwave energy downwardly within said casing, a radiator unit connected to the lower end of said transmitting means having a plurality of slots therein, said slotted radiator unit projecting beneath the lower end of said casing for propagating at least some of said microwave energy into said subterranean formation via said slots, said radiator unit including a waveguide having a relatively flat vertical wall, said vertically spaced slots being located in said relatively flat vertical wall.

36. An oil recovery system in accordance with claim 35 in which said slots are angularly oriented.

37. An oil recovery system in accordance with claim 36 including a probe associated with each slot and extending inwardly therefrom.

38. An oil recovery system in accordance with claim 37 in which said slots are oriented at approximately 30° with respect to a vertical line.

39. An oil recovery system comprising a well casing, means within said casing for conducting fluid upwardly through said casing from a subterranean petroleum-bearing formation, means within said casing for transmitting microwave energy downwardly within said casing, a radiator unit connected to the lower end of said transmitting means having a plurality of slots therein, said slotted radiator unit projecting beneath the lower end of said casing for propagating at least some of said microwave energy into said subterranean formation via said slots, said transmitting means including a first waveguide, and said slotted radiator unit including a second waveguide having a relatively flat first wall, said slots being in said first wall.

40. An oil recovery system in accordance with claim 39 in which said second waveguide includes second, third and fourth walls, said second wall, including first, second and third panel sections, said first panel section being parallel to said first wall and said second and third panel sections diverging from said first panel section to form a groove.

41. An oil recovery system in accordance with claim 40 in which said second wall additionally includes a fourth panel section extending from said second panel section in a parallel relation with said first panel section, and a fifth panel section extending in a parallel relation with said first panel section.

42. An oil recovery system in accordance with claim 41 including a probe extending inwardly from each of said slots toward said first panel section.

43. An oil recovery system in accordance with claim 42 in which each of said slots is oriented at an angle of approximately 30° with respect to a vertical line.

44. An oil recovery system in accordance with claim 43 in which said first waveguide has a cross section corresponding to that of said second waveguide.

45. In a system for in situ heating underground hydrocarbonaceous material via a bore hole of restricted cross sections, a waveguide having a width somewhat less than that of the bore hole, said waveguide having a plurality of slots in one wall thereof, and a probe extending inwardly from said wall at generally right angles thereto.

46. An oil recovery method comprising the step of disposing production tubing and a radio frequency transmission line in a well casing, at least portions of said tubing and said transmission line being in engagement, attaching a slotted radiator unit to said transmission line having a plurality of vertically oriented slots, first introducing said radiator unit into said well casing followed by said transmission line and tubing, and tuning at least one of said slots for the particular characteristics of the subterranean oil-bearing formation with which said slot is aligned.

47. An oil recovery method in accordance with claim 46 in which said radiator unit comprises an outer metal cylinder and a coaxial conductor therein, said cylinder having a plurality of vertical slots therein, the method including the step of increasing the peripheral distance from one side of each slot to the other side thereof.

48. An oil recovery method comprising the step of radiating microwave energy at a first frequency into a petroleum-bearing subterranean formation at one depth, and radiating microwave energy at a second frequency into the subterranean formation at a different depth, said first and second frequencies differing from each other.

49. An oil recovery system comprising a well casing, means within said casing for conducting fluid upwardly through said casing from a subterranean petroleum-bearing formation, means externally located with respect to said casing for generating microwave energy, means within said casing for transmitting said microwave energy downwardly within said casing from said externally located generating means, and a radiator unit connected to the lower end of said transmitting means including a metal cylinder and a centrally located conductor therewithin, said metal cylinder having at least one slot therein, and a shorting device associated with said slot for correlating the impedance matching of the radiator unit with the particular characteristics of the underground oil-bearing formation.

50. An oil recovery system in accordance with claim 49 in which said centrally located conductor is in the form of a tube, said metal cylinder and said tube having radially aligned openings, and a shorting plug received in said openings, and means for moving said shorting plug radially to effect said correlated impedance match.

51. An oil recovery system in accordance with claim 50 including a plurality of vertically spaced slots in said metal cylinder, each of said slots having a shorting device associated therewith.

52. An oil recovery system in accordance with claim 51 in which said generating means supplies microwave energy at two different frequencies, one of said shorting devices being adjusted for one of said frequencies so that microwave energy at said one frequency is radiated into the subterranean formation at one depth and with a correlated impedance match with the particular characteristics of the underground oil-bearing formation at said one depth, and another of said shorting devices being adjusted for the other of said frequencies so that the microwave energy at the other of said frequencies is radiated into the subterranean formation at a different depth and with a correlated impedance match with the particular characteristics of the underground oil-bearing formation at said different depth.

53. An oil recovery system comprising a well casing, means within said casing for conducting fluid upwardly through said casing from a subterranean petroleum-bearing formation, means externally located with respect to said casing for generating microwave energy, means within said casing for transmitting said microwave energy downwardly within said casing from said externally located generating means, and slotted means at the lower end of said transmitting means for propagating at least some of said microwave energy into said subterranean formation at a plurality of vertically spaced locations.

* * * * *